US005090844A

United States Patent [19]

Pacchiosi

[11] Patent Number: 5,090,844

[45] Date of Patent: Feb. 25, 1992

[54] PLANT FOR DIGGING AND SHORING UP THE WALLS OF TUNNELS DURING EXCAVATION

[76] Inventor: Doriano Pacchiosi, No. 9, Via Serraglio Barbû-Frazione Coltaro, 43033 Sissa, Italy

[21] Appl. No.: 575,447

[22] Filed: Aug. 30, 1990

[51] Int. Cl.[5] ..... E21D 9/00

[52] U.S. Cl. ..... 405/145; 405/142; 405/138

[58] Field of Search ..... 405/146, 142, 145, 140, 405/138

[56] References Cited

U.S. PATENT DOCUMENTS

| | | | |
|---|---|---|---|
| 3,613,384 | 10/1971 | Jacobs | 405/146 X |
| 4,095,435 | 6/1978 | Vemura | 405/138 X |
| 4,398,845 | 8/1983 | Stuckmann et al. | 405/145 |
| 4,640,646 | 2/1987 | Hentschel | 405/146 X |
| 4,789,267 | 12/1988 | Babendererde et al. | 405/146 |
| 4,813,813 | 3/1989 | Yamamoto et al. | 405/146 |

FOREIGN PATENT DOCUMENTS

| | | | |
|---|---|---|---|
| 3032856 | 3/1982 | Fed. Rep. of Germany . | |
| 3630149 | 3/1988 | Fed. Rep. of Germany | 405/146 |
| 2180867 | 4/1987 | United Kingdom . | |

*Primary Examiner*—Dennis L. Taylor
*Assistant Examiner*—J. Russell McBee
*Attorney, Agent, or Firm*—Laff, Whitesel, Conte & Saret

[57] ABSTRACT

The invention falls within the art field of shields used in the excavation of tunnels for any given utility (rail, road, underground railway, sewers, pipelines, power cables etc.), and of all sizes. The plant disclosed provides a temporary support structure for tunnel walls, entirely self-propelled and extendible along the direction of excavation, the interior of which accommodates equipment used in digging operations and for the removal of spoil; accordingly, the structure acts as a temporary shoring facility during excavation works, moving forward through the bore and carrying within it the complete battery of excavation and auxiliary equipment while enabling installation immediately behind of the permanent pre-cast or cast in-situ tunnel lining.

4 Claims, 3 Drawing Sheets

PLANT FOR DIGGING AND SHORING UP THE WALLS OF TUNNELS DURING EXCAVATION

BACKGROUND OF THE INVENTION

The present invention relates to a plant designed for use in digging and shoring up excavations during tunnelling works.

In recent times, a number of different techniques have been employed in the construction of tunnels, for road or rail, for utilities such as sewers or underground canals, and for the routing of water courses generally.

One such technique involves the use of mechanical shields to carry the excavation forward while installing pre-cast lining sections (tubular or segmental) as digging proceeds. These shields can be driven forward by hydraulic jacks from outside, using the pre-cast tunnel linings already installed as intermediate elements in a growing chain.

The distances obtainable using this expedient are not great, however, given that friction increases progressively with length, and impossible demands are put on the strength of the intermediate linings as greater and greater thrust is applied.

The shield can also be driven forward utilizing the previously installed section of the tunnel lining (pre-cast or cast-in-situ) as a fixed bearing. In this instance, however, limitations are imposed on forward progress by the capability of the lining to withstand the thrust of the hydraulic jacks; more exactly, on encountering a degree of lateral friction or resistance to penetration greater than the mechanical strength of the lining, the shield obviously can no longer operate, inasmuch as the force required to produce increased thrust would destroy the lining.

This drawback is partly overcome in the majority of cases by installing intermediate stations as shown in German patent application n 3 032 856, against which to exert the necessary thrust, though the reaction force from such stations is transmitted just the same either to adjacent sections that are not designed to withstand high pressures, and thus will be in danger of breaking up, or to a lining cast in-situ, which becomes subject to considerable stresses.

In addition, increased friction must be overcome in driving forward where the bore has to follow a gentle bend; in this particular situation moreover, the direction of thrust no longer coincides with the bore axis, and there is no means of altering the direction except by way of the jacks, which are located remotely from the section that is required to change course.

An apparatus for tunnelling through soft stratum illustrated in UK patent application n 2 180 867 comprises a body portion having a plurality of cylindrical members connected together, a head portion connected to one of the cylindrical members at one of its ends, a waterproof frame disposed between the head portion and cylindrical member, a plurality of pneumatic cylinders disposed between each two of the cylindrical members and a plurality of grouting pipes mounted at the tail end of the body portion. With this apparatus the reaction force is transmitted to cement grout.

Another apparatus and method for continuously or intermittently advancing tunnel supports against surrounding earth pressure is shown in U.S. Pat. No. 3,613,384. The cutting edge and trailing shells are interconnected by a longitudinal frame or cage structure. Intermediate the forward and trailing shell are overlapping intermediate shells connected individually to the cage structure by hydraulic cylinders so that each intermediate shell can be moved longitudinally relative to the others and relative to the tunnel wall while the other intermediate shells engage the tunnel wall and advance the cage as well as the forward or support shell and the trailing shell. The intermediate shells are moved forward sequentially by releasing pressure exerted against the wall, as by contracting the shell.

Where the tunnelled ground is clay, or other loose soil lacking in consistency, conventional prior art methods involve manual or mechanical excavation, shoring and installation of temporary supports or centers, then driving forward, consolidating the exposed walls, and ultimately casting the tunnel lining.

In this type of procedure, consolidation consists generally in driving piles into and jet grouting the entire supporting wall of the tunnel; needless to say, the piles remain embedded, and will be concealed behind the lining of the tunnel once in place.

Methods of the kind in question are also beset by certain limitations and drawbacks, namely:

- high costs deriving from the slow rate of progress and the high manning requirement which accompanies the various steps of the procedure;
- dangerous operating conditions (risk of collapse at the workings), for those occupied in excavation and erecting temporary centerings;
- waste of materials produced in erecting temporary structures pending installation of final linings.

The object of the present invention is to permit of excavating a tunnel of any given diameter or cross section, and of whatever length, without subjecting precast linings to high thrust stresses.

A further object of the invention is to achieve a considerable reduction in the cost of shoring up the tunnel walls during the course of excavation. Another object of the invention is to provide a temporary shield structure during excavation and subsequent casting/lining works such as will ensure maximum safety during the construction of tunnels of any given size and length, undertaken in loose or unstable ground.

Yet another object of the invention is to enable excavation of the tunnel using conventional and readily available digging equipment, thus bringing the advantages of low running costs and the option of varying excavation and spoil-removal methods in such a way as will best adapt to the type of ground encountered in the course of tunnelling.

An additional object of the present invention is to render the steps of excavation, driving and lining independent of one another.

SUMMARY OF THE INVENTION

The stated objects are realized comprehensively in plant according to the invention, which relates to a shield of the type used in tunnel excavation, and consists in a self-propelled modular structure affording temporary support to the excavated tunnel walls and housing the tunnelling equipment, which is extendible, and designed to advance and/or drive through the ground without the assistance of fixed thrust bearings, but exploiting exclusively its own mass and/or lateral friction generated between each element of the modular structure and the adjacent tunnel wall to provide the force of reaction.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
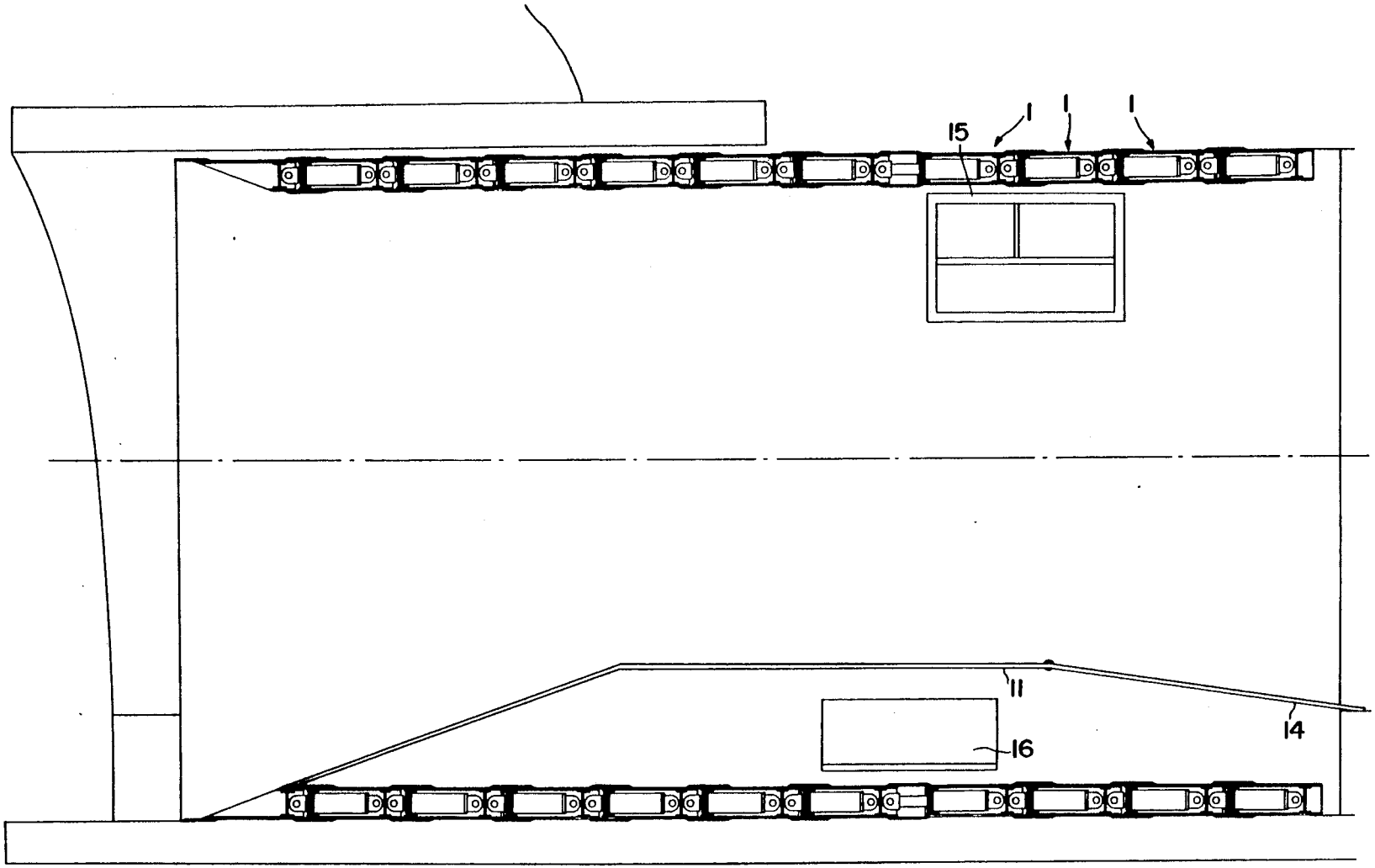
FIG. 1 shows the plant disclosed in longitudinal section, viewed in the initial stages of excavating a tunnel.
Figure 2:
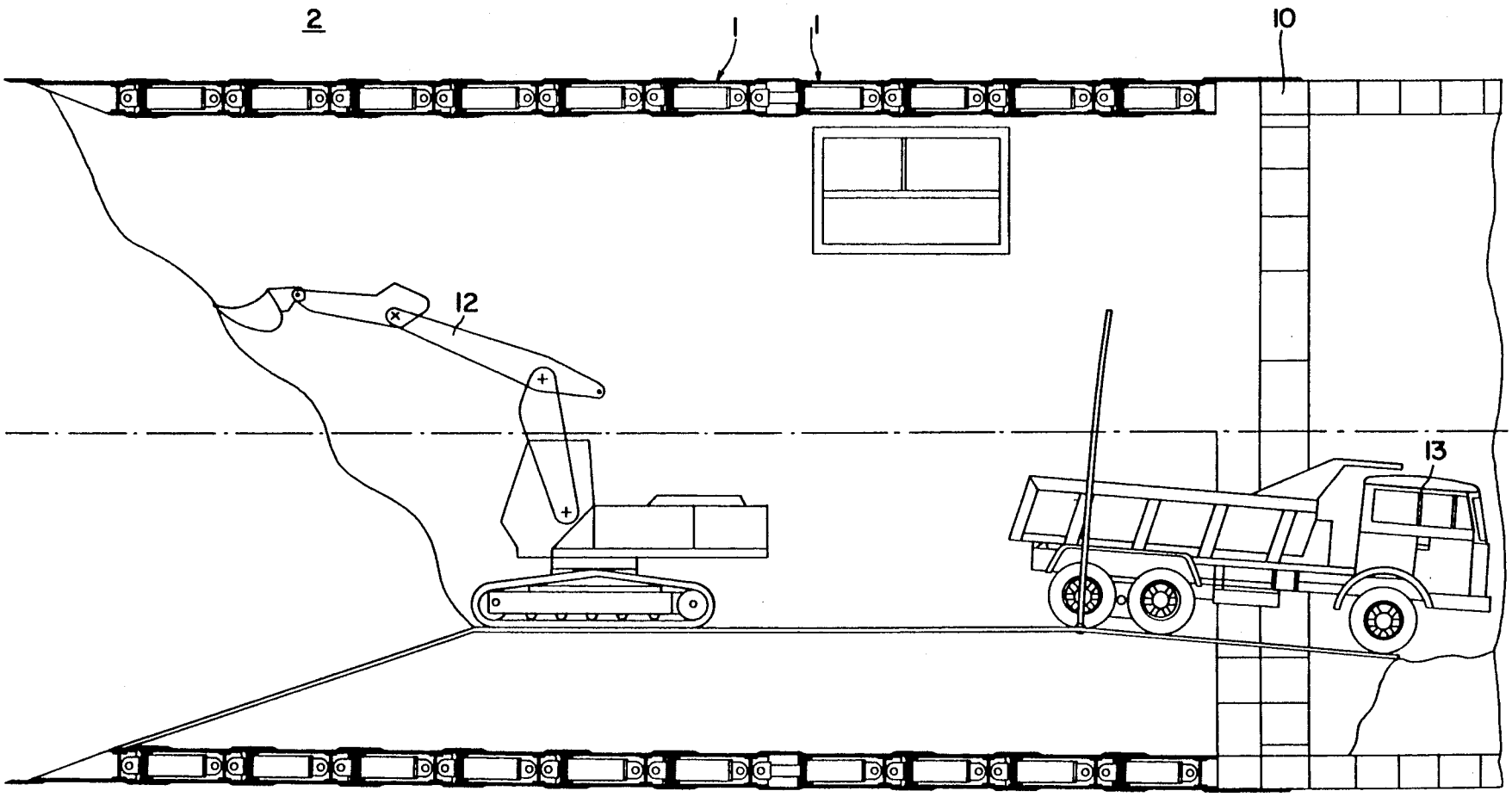
FIG. 2 shows the plant in the same section as that of FIG. 1, seen fully inside the tunnel.

With reference to the drawings, the plant according to the invention consists in a plurality of modular structures or cylindrical elements 1, by which the wall of the tunnel 2 is completely masked.

Each modular element 1 consists substantially in a first ring 3 of 'I' section, to which the rear ends of a plurality of hydraulic cylinders 4 are hinged, and a second ring 3*a* through which the rod ends of the cylinders are inserted, the rods 5 themselves being mounted by way of respective pivots 6 to the first ring 3*b* of the adjacent element.

The hydraulic cylinders are encompassed by an inner annular sheet member 7 and an outer annular sheet member 8, of which the outer member lies in direct contact with the excavated bore.

Propulsion of the structure is brought about by operating the cylinders in such a way that each modular element is driven forward by the cylinders anchored to the element behind.

With the leading element and successive elements thus linked in a chain and generating friction with the tunnel wall, the reaction necessary for forward progress is ensured; as regards the development of thrust, in short, the structure is self-anchoring: accordingly, the first elements in sequence, i.e. those farthest from the work face, are drawn toward the excavation area, and the entire structure edges forward as the result of the combination of thrust, generated at the leading end, and the pull exerted on the rear end.

In a preferred embodiment, each modular element will be some 2 meters in length, and the number of elements utilized will be such that the length of the assembled structure is substantially equal to the diameter of the bore at least, or twice the diameter at most.

Figure 3:
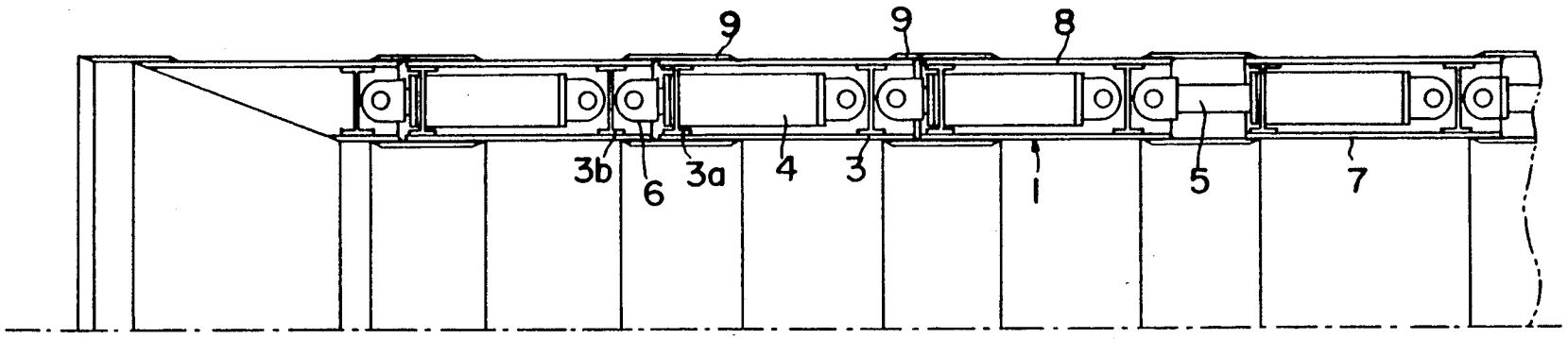
FIG. 3 shows a detail of the plant on larger scale.

Given that operating the cylinders of one modular element has the effect of distancing the element in front, a space is opened between one element and the next which leaves the cylinder rods exposed. To avoid this eventuality and ensure the continuity of the shield, the structure further comprises plates 9 rigidly associated with the annular sheet members 7 and 8 of one element and slidable over those of the next, thereby encapsulating the space occupied by the extended rods 5 as illustrated in FIG. 3.

The plant will carry a work platform 11 from which excavators 12 have access to the face, the spoil being removed by ordinary trucks 13 that enter and leave via a tiltable ramp section 14 connecting the platform 11 with the part of the tunnel already lined or otherwise prepared, which is denoted 10. 15 and 16 respectively denote the operator's cab and the hydraulic power unit.

The plant, thus embodied, provides a temporary shoring structure that is self-propelled and extendible, capable of passing along the entire length of the bore and emerging at the far end.

Use is made of modular elements n having a cross section equal to or greater than that of the finished tunnel, and of length l, where n and l are variable according to the dimensions of the bore and the type of ground through which it is to be driven. The elements are fastened and/or hinged together by way of hydraulic cylinders, as illustrated, and/or of other suitable propulsion and steering means. The extendible structure thus embodied accommodates all such excavating equipment and transportation as may be utilized, carrying them along as it edges forward; moreover, the plant advances and pushes through the soil without the aid of any additional fixed bearing, whether placed externally or to the rear, given that the hydraulic cylinders (or other suitable propulsion means such as worm drives) are able to bring about the movement and penetration of one or more elements with no expedient utilized to counteract thrust other than the mass of the single elements and/or the effects of lateral friction. What is more, by exercising uniform and/or suitably proportioned control over the hydraulic cylinders or other suitable drive means interconnecting the rings, it becomes possible to steer the structure accurately through bends, of which the radius will vary according to the number of modular elements incorporated and their individual length.

The invention thus affords several advantages:

- the excavation site is made safe, since digging and lining operations are carried on entirely from within the structure, functioning as a shield by shoring up the excavated walls; any collapse of the earth at the work face can be avoided or attenuated by penetrating deeper with the leading end, given that the structure is extendible through a distance of meters m (dependent on the number n of elements incorporated and the travel permitted to each one), and can therefore penetrate the necessary depth at front while the rear end remains in position until the relative stretch of lining is in place;
- an extendible tunnelling shield brings operational flexibility, with excavation, removal of spoil and casting/assembly of linings becoming independent of one another;
- the capacity of the plant to act as a temporary shoring structure renders conventional centering, shuttering and consolidation works unnecessary, signifying notable advantages from the standpoints of time-saving and cost reduction;
- propulsion is effected without additional fixed bearings to accommodate thrust, enabling unlimited progress through any type of ground;
- the shield is easily set in motion, requiring no reaction pillars or tracks, but simply the laying of blocks and the preparation of a starting ring at the tunnel mouth;
- with the assembly of modular elements operating as a self-propelled structure, and no need to exploit the installed tunnel lining as a reaction bearing for propulsion jacks, linings can be proportioned without any provision for additional loading.

What is claimed:

1. A plant for digging and shoring up the walls of tunnels during their excavation, comprising a self-propelled extendible modular structure affording temporary support to the excavated tunnel walls, said plant structure being extendible while carrying all such equipment as may be used in excavating the tunnel and removing the spoil, said plant structure advancing and driving through the ground without the assistance of fixed thrust bearings, but exploiting exclusively its own mass and lateral friction generated between each modular element and the adjacent tunnel wall to provide the force of reaction, said structure including a succession of modular cylindrical elements, each of which comprises a first ring and a second ring that are rigidly interconnected by two annular sheet metal members, a plurality of hydraulic cylinders which are hinged to the first ring and which are inserted into the second ring, said cylinders being encompassed by at least one annular sheet member and including associated extendible rods that are hinged to the first ring of the modular cylindrical element next in succession.

2. The plant of claim 1, wherein said cylindrical elements are coaxial, said elements masking the tunnel walls and said elements further including means which operate between and push and pull the elements one in relation to another.

3. A plant for digging and shoring up walls of tunnels during their excavation comprising:

a succession of modular cylindrical elements which provide mass and generate friction with the tunnel wall for forward movement, each of said elements having a first ring and a second ring;

a plurality of hydraulic cylinders having associated extendible rods, each of said cylinders having a rear end and a rod end, said rear end of each of said cylinders being hinged to said first ring and said rod end of each of said cylinders being inserted into said second ring;

an inner annular sheet member and an outer annular sheet member, said members encompassing said hydraulic cylinders and interconnecting said first ring and said second ring, said outer annular sheet member being in direct contact with said walls of said tunnel; and a plurality of plates, each of said plates being rigidly associated with said inner and outer sheet members and encapsulating the space occupied by said extended rods of said cylinders.

4. The plant of claim 3 wherein said rods are mounted by at least one pivot.

* * * * *